US011081027B2

(12) United States Patent
Flint et al.

(10) Patent No.: US 11,081,027 B2
(45) Date of Patent: Aug. 3, 2021

(54) FRONT-ILLUMINATED SIGN

(71) Applicant: Everbrite, LLC, Greenfield, WI (US)

(72) Inventors: James M. Flint, Glasgow, VA (US); Samuel L. Campbell, Vesuvius, VA (US); Paul R. Ramsey, Fairfield, VA (US); Timothy A. Newell, Buena Vista, VA (US)

(73) Assignee: Everbrite, LLC, Greenfield, WI (US)

( * ) Notice: Subject to any disclaimer, the term of this patent is extended or adjusted under 35 U.S.C. 154(b) by 0 days.

(21) Appl. No.: 17/008,895

(22) Filed: Sep. 1, 2020

(65) Prior Publication Data

US 2021/0065586 A1 Mar. 4, 2021

Related U.S. Application Data

(60) Provisional application No. 62/895,241, filed on Sep. 3, 2019.

(51) Int. Cl.

| | |
|---|---|
| ***G09F 7/22*** | (2006.01) |
| ***G09F 13/22*** | (2006.01) |
| ***G09F 13/04*** | (2006.01) |

(52) U.S. Cl.

CPC ..... *G09F 7/22* (2013.01); *G09F 13/0413* (2013.01); *G09F 13/22* (2013.01); *G09F 2013/0445* (2013.01); *G09F 2013/222* (2013.01)

(58) Field of Classification Search

CPC . G09F 13/02; G09F 7/22; G09F 13/22; G09F 13/0413; G09F 2013/222; G09F 2013/0445; F21V 21/26; F21V 21/28; F21V 21/30; F21V 21/14; F21V 21/108; F21V 21/108116; F21S 4/20; F21S 4/28; F21S 8/086

See application file for complete search history.

(56) References Cited

U.S. PATENT DOCUMENTS 3,108,751 A * 10/1963 Rodmaker ..... F21S 8/00 362/427

3,685,666 A * 8/1972 Rose ..... G09F 15/0068 211/199

(Continued)

OTHER PUBLICATIONS

Shine Retrofits, "LED Outdoor Sign Lighting", webpage: https://www.shineretrofits.com/applications/led-induction-energy-efficient-sign-billboard-light-fixtures/led-sign-billboard-lighting.html, © 2017, 9 Pages.

(Continued)

*Primary Examiner* — Cassandra Davis

(74) *Attorney, Agent, or Firm* — Michael Best & Friedrich LLP

(57) ABSTRACT

A sign including a frame configured to support a sign face. The frame includes a first section and a second section. The sign also includes a first bracket coupled to the frame, the first bracket defines a longitudinal axis, and a second bracket coupled to the first bracket. The second bracket is rotatable with respect to the first bracket, and the second bracket is movable between a first position in which the second bracket extends transverse to the longitudinal axis and a second position in which the second bracket extends along the longitudinal axis. The sign also includes a light bar coupled to the second bracket. The second section is movable with respect to the first section between an installed position and a collapsed position.

20 Claims, 8 Drawing Sheets

(56) References Cited

U.S. PATENT DOCUMENTS

| | | | | |
|---|---|---|---|---|
| 5,613,314 | A | 3/1997 | Leverenz et al. | |
| 5,934,787 | A * | 8/1999 | Sharma | F21S 8/00 362/147 |
| 6,203,175 | B1 * | 3/2001 | Basacchi | F21S 9/02 362/287 |
| 6,510,633 | B1 * | 1/2003 | Bledsoe | G09F 13/02 362/220 |
| 7,066,619 | B2 * | 6/2006 | Waters | F21S 8/033 362/147 |
| 9,349,307 | B1 | 5/2016 | Auyeung et al. | |
| 2005/0057125 | A1 * | 3/2005 | Yingst | G09F 13/02 312/137 |
| 2009/0290338 | A1 | 11/2009 | Heller et al. | |
| 2010/0085757 | A1 * | 4/2010 | Barkdoll | F21V 21/26 362/282 |

OTHER PUBLICATIONS

Amertrix, "Arrowlinear LED Sign Lighting Installation Instructions", webpage: http://www.cooperindustries.com/content/dam/public/lighting/products/documents/ametrix/instruction_sheets/INSTALLATION%201NSTRUCTION%20AC%20AK%20%20LED.pdf, Available prior to Sep. 2020, 3 Pages.

Formetco Hardware, Bricklite, "LED Installation Guide", webpage:https://www.formetcohardware.com/wp-content/uploads/2019/02/BrickLite_Installation.pdf, Available prior to Sep. 2020, 1 Page.

* cited by examiner

FRONT-ILLUMINATED SIGN

CROSS-REFERENCE TO RELATED APPLICATIONS

This application claims priority to U.S. Provisional Patent Application No. 62/895,241, filed on Sep. 3, 2019, the entire contents of which are incorporated herein by reference.

FIELD OF THE INVENTION

The present invention relates to illuminated signs, and more particularly to front-illuminated signs.

BACKGROUND OF THE INVENTION

Front-illuminated signs are often installed separately from their lighting fixtures, which makes the installation and alignment between the sign and the lighting fixture difficult, time-consuming and costly, particularly for large signs and uneven mounting surfaces.

SUMMARY OF THE INVENTION

The invention provides, in one aspect, a sign including a frame configured to support a sign face. The frame includes a first section and a second section. The sign also includes a first bracket coupled to the frame, the first bracket defines a longitudinal axis, and a second bracket coupled to the first bracket. The second bracket is rotatable with respect to the first bracket, and the second bracket is movable between a first position in which the second bracket extends transverse to the longitudinal axis and a second position in which the second bracket extends along the longitudinal axis. The sign also includes a light bar coupled to the second bracket. The second section is movable with respect to the first section between an installed position and a collapsed position.

The invention provides, in another aspect, a sign including a frame configured to support a sign face, a first bracket coupled to the frame, and a second bracket coupled to the first bracket. The second bracket is rotatable with respect to the first bracket about an axis. The sign further includes a light bar coupled to the second bracket.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
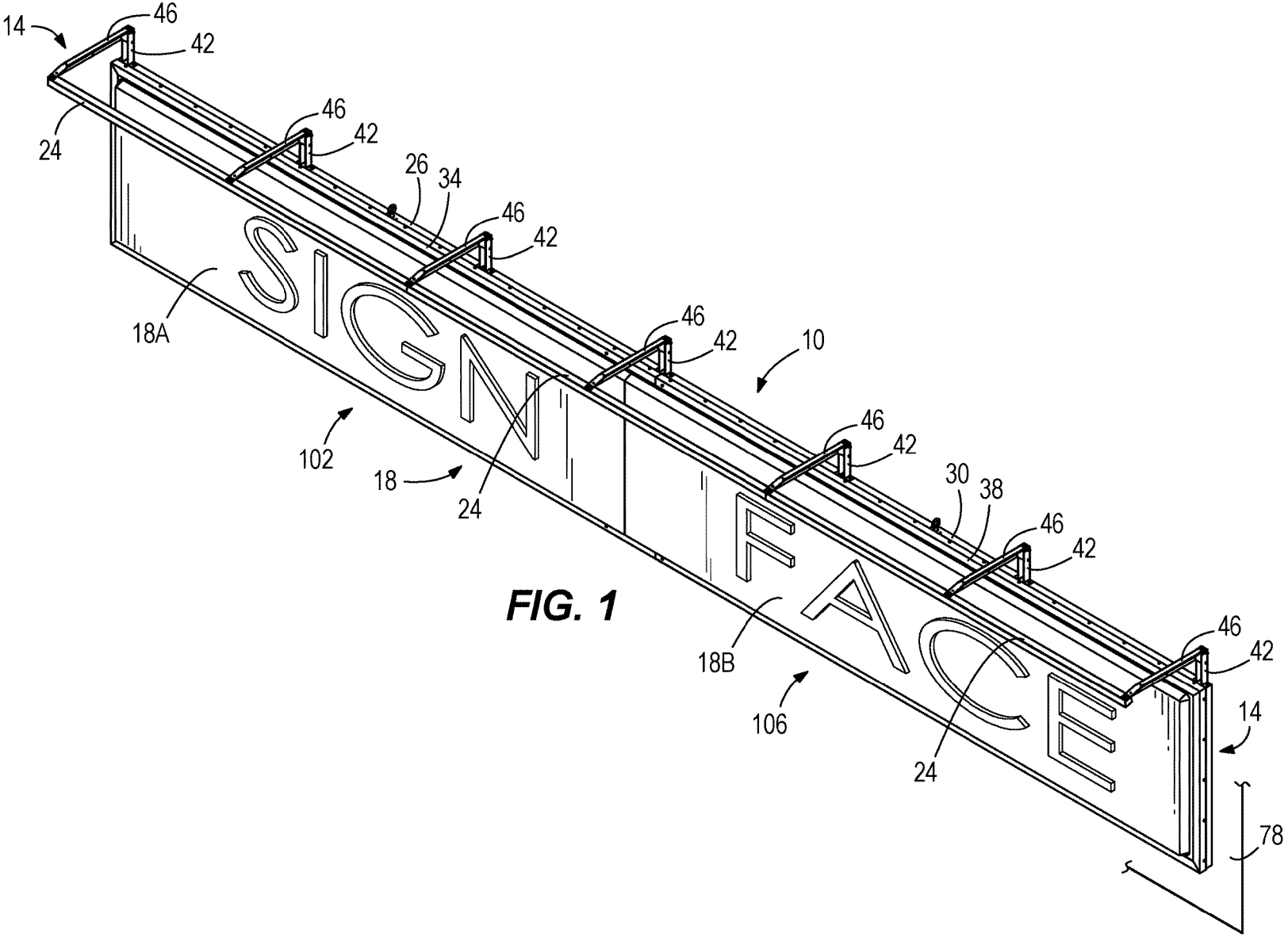
FIG. 1 is a front perspective view of a front-illuminated sign according to one embodiment of the invention.

FIG. 1 illustrates a front-illuminated sign 10 including a frame assembly 14, a face assembly 18, and a light bar assembly 22 coupled to the frame assembly 14. The sign face assembly 18 has letters, images, symbols or some other message directed to the viewing public. In the illustrated embodiment, the sign face assembly 18 includes a first panel 18A and a second panel 18B. The light bar assembly 22 includes light bars 24 to provide illumination of the sign face assembly 18.

Figure 2:
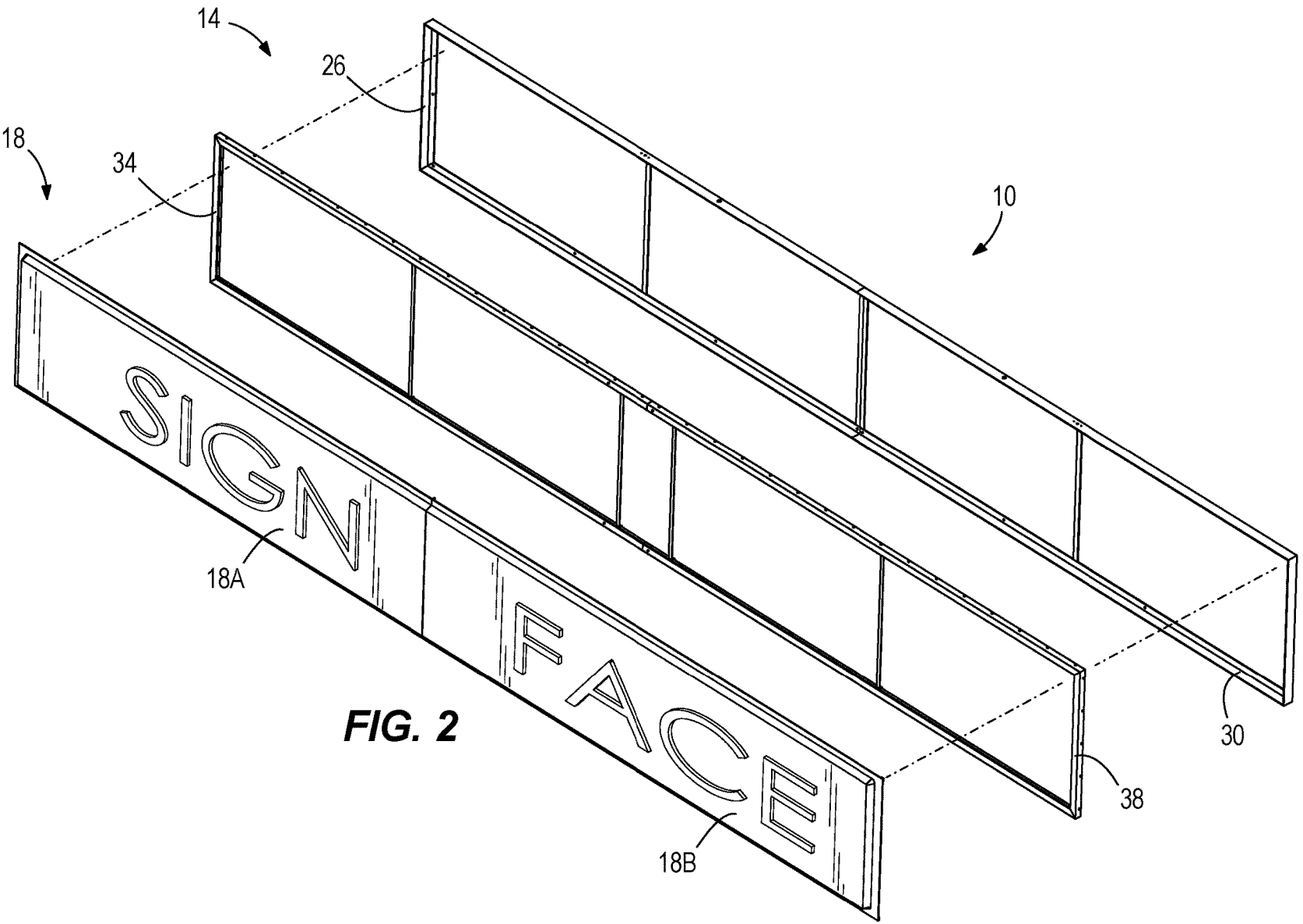
FIG. 2 is an exploded view of a sign face and sign frame according to one embodiment of the invention.
Figure 3:
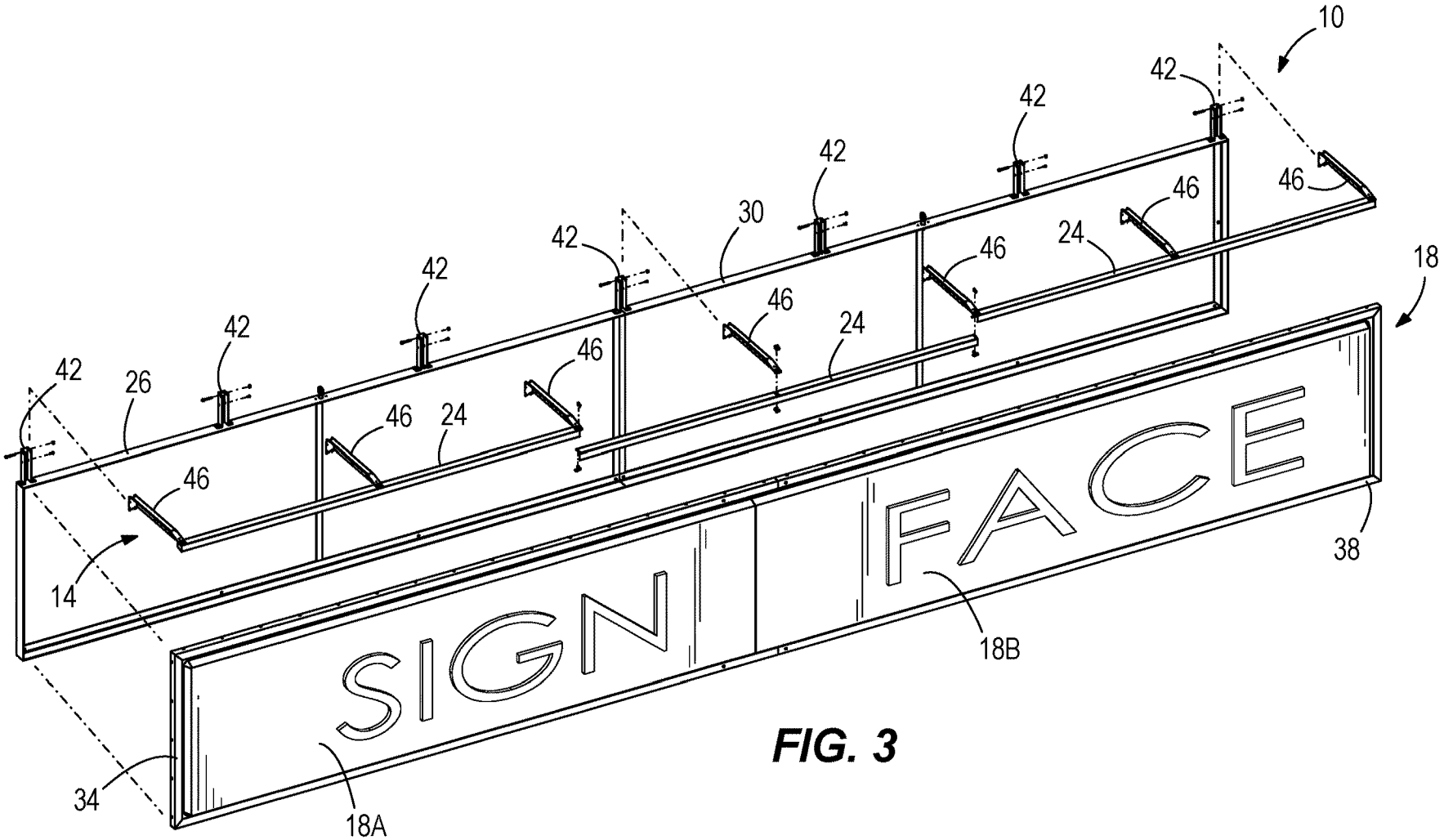
FIG. 3 is an exploded view of a front-illuminated sign face and sign frame having pre-installed mounting brackets according to one embodiment of the invention.

With reference to FIG. 2, the sign frame assembly 14 includes a first frame section 26 and a second frame section 30. In some embodiment, the first frame section 26 is removable from the second frame section 30. In other embodiments, the frame assembly 14 includes a third section that is positioned between the first section and the second section when the sign 10 is installed. In the illustrated embodiment, the frame assembly 14 also includes frame members 34, 38 to receive the first panel 18A and the second panel 18B of the sign face assembly 18. The frame members 34, 38 positioned the panels 18A, 18B together to create a message for the viewing public (FIG. 3). In other embodiments, the frame assembly 14 does not include the members 34, 38 and the panels 18A, 18B are secured directly to the frame sections 26, 30. In other words, the frame assembly 14 is configured to support sign face assembly 18.

With reference to FIG. 3, the sign 10 further includes a first bracket 42 coupled to the frame assembly 14. In the illustrated embodiment, there are seven first brackets 42 affixed to the frame assembly 14 with three first brackets 42 coupled to the first frame section 26, three first brackets 42 coupled to the second frame section 30, and one first bracket 42 coupled to both the frame sections 26, 30. The sign 10 also includes a second bracket 46 coupled to the first bracket 42. The second bracket 46 is rotatable with respect to the first bracket 42 about an axis 50. In the illustrated embodiment, the sign 10 includes seven second brackets 46 with one second bracket 46 corresponding to each of the first brackets 42.

With continued reference to FIG. 3, the sign 10 includes the light bar 24 coupled to the second bracket 46. In the illustrated embodiment, the sign 10 includes three light bars 24 each of which is coupled to three of the second brackets 46. In the illustrated embodiment, the light bars 24 are interconnected with frame sections 26, 30 by at least one of the first brackets 42 and at least one of the second brackets 46. The second brackets 46 are connected between the first bracket 42 and the light bar 24.

Figure 4A:
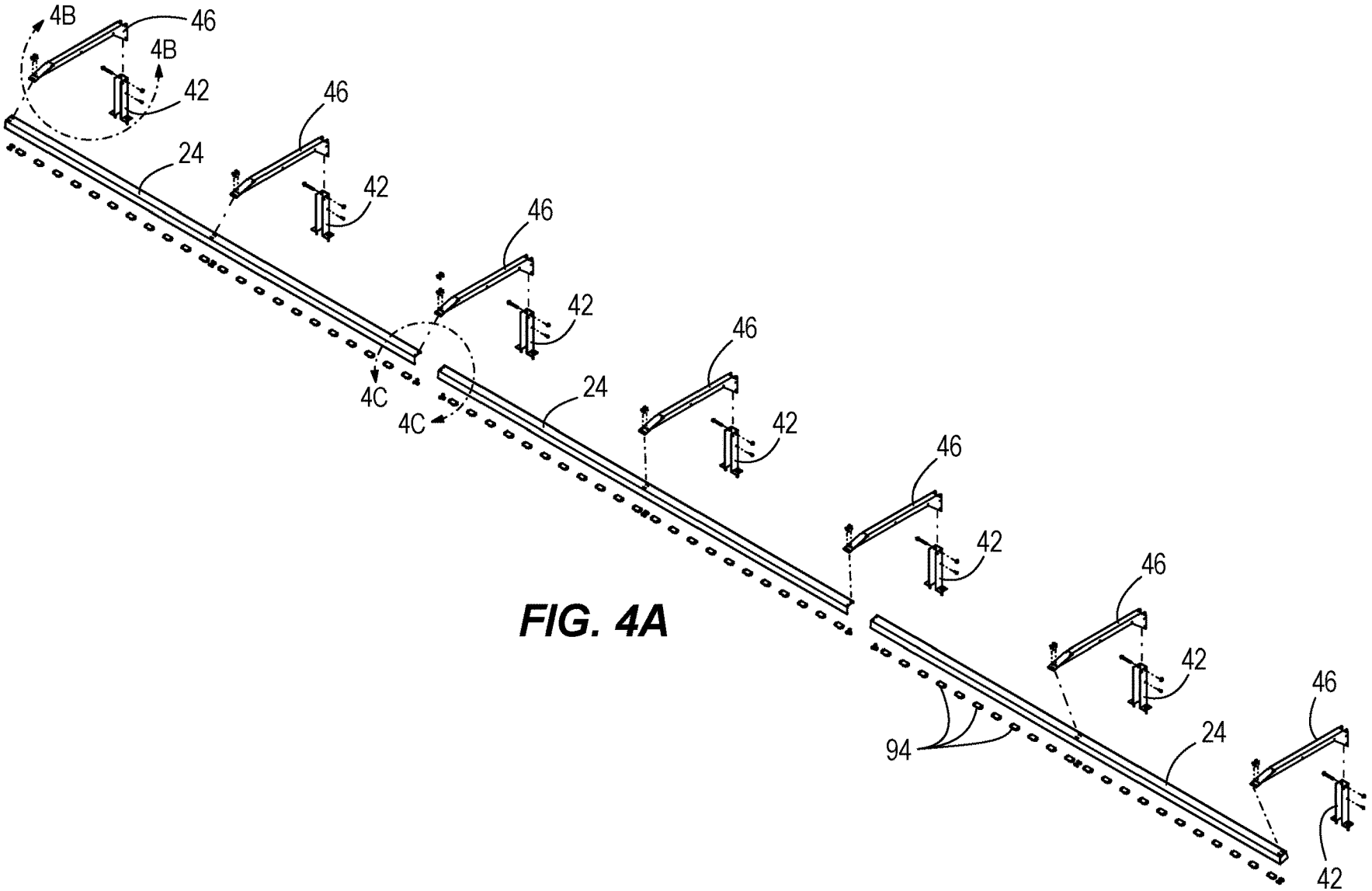
FIG. 4A is an exploded view depicting a light bar assembly according to one embodiment of the invention.
Figure 4B:
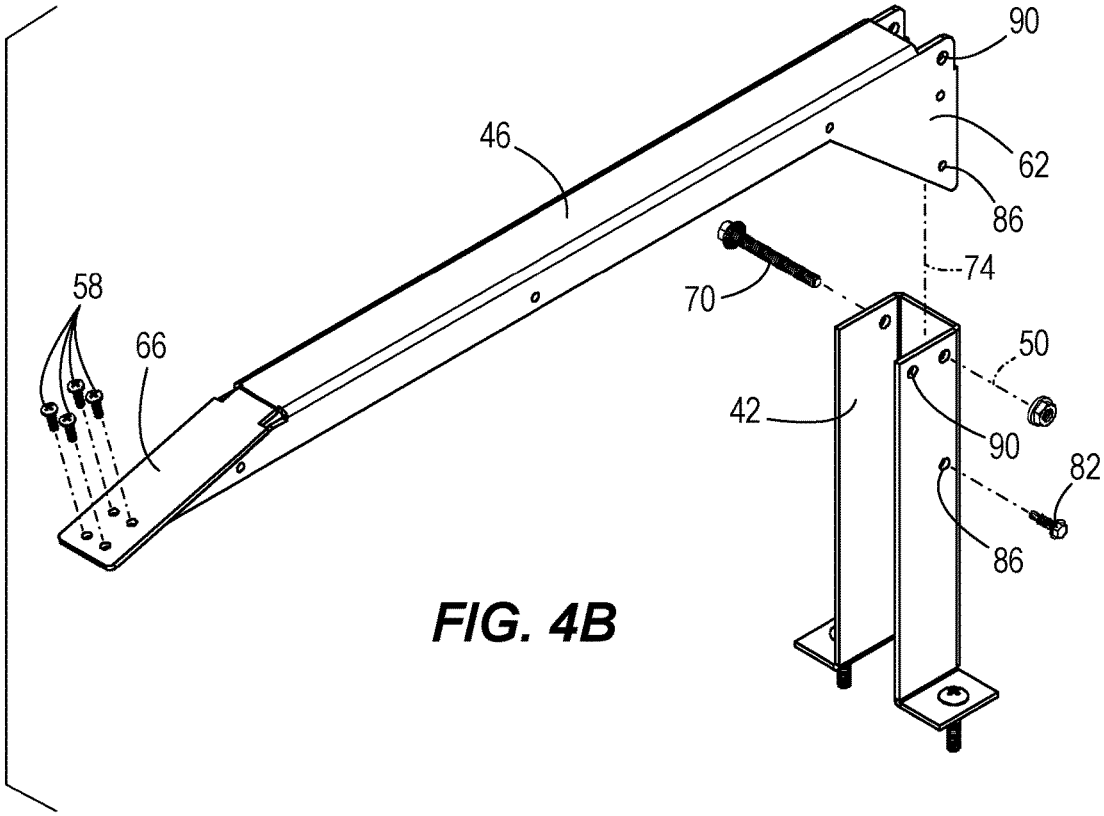
FIG. 4B is an enlarged, exploded view showing the mounting brackets for the light bar assembly of FIG. 4A.

With reference to FIG. 4A, the light bars 24 are coupled to the second bracket 46 by fasteners 58 (e.g., screws, bolts, nuts, or any other suitable hardware). With reference to FIG. 4B, the second bracket 46 includes a first end 62 that connects with the first bracket 42 and a second end 66, opposite the first end 62, that connects with the light bar 24. In the illustrated embodiment, the first end 62 forms a triangular-shaped mount and the second end 66 forms an angled mount.

Figure 5:
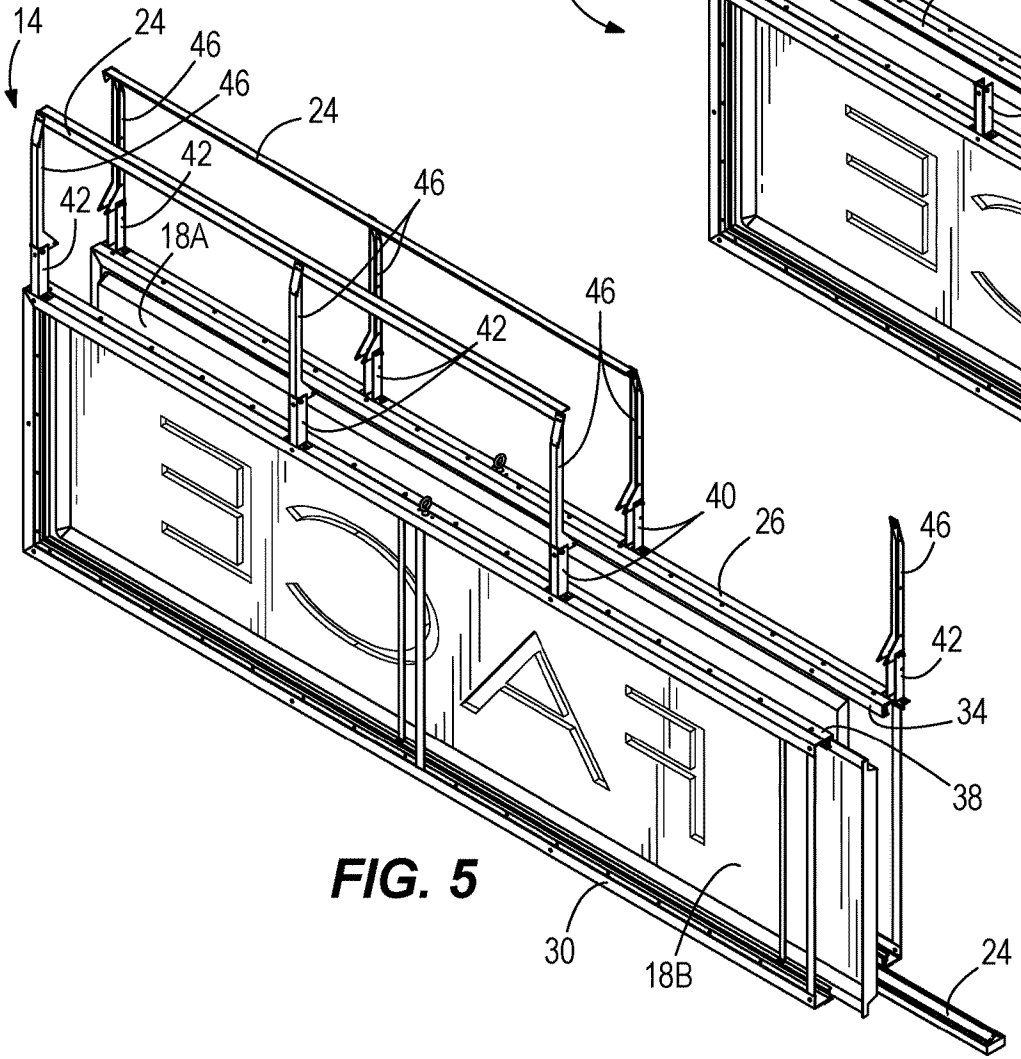
FIG. 5 is a perspective view of a compact shipping configuration of the front-illuminated sign according to one embodiment of the invention.
Figure 8:
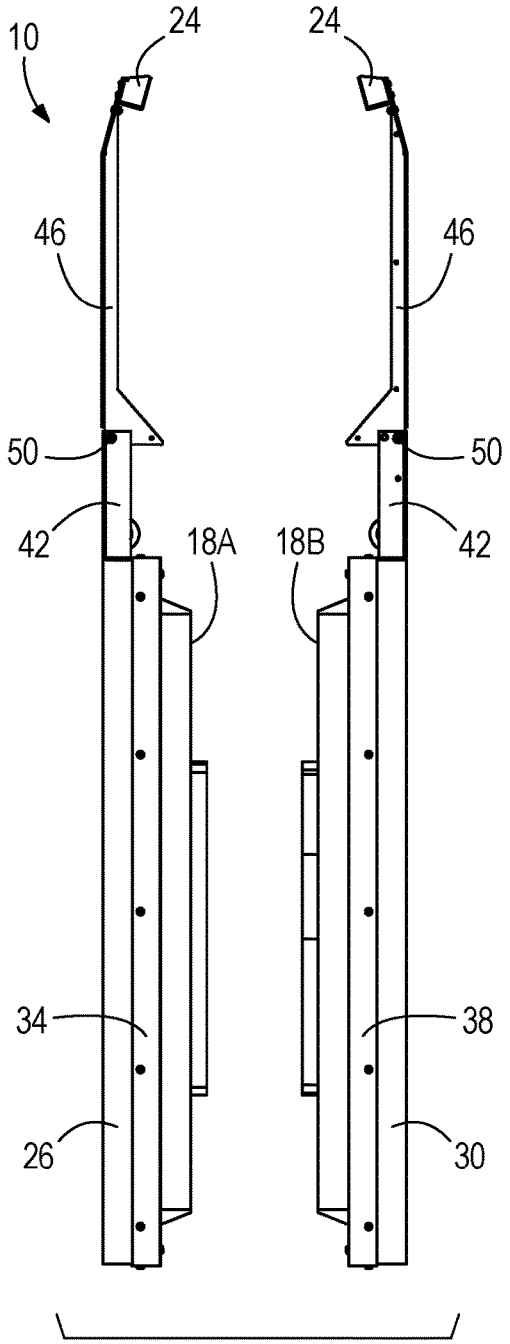
FIG. 8 is a side view of the compact shipping configuration of FIG. 5.

With continued reference to FIG. 4B, the second bracket 46 is rotatably coupled to the first bracket 42 by a fastener 70 that defines the axis 50. In other words, the fastener 70 connects the first end 62 to the first bracket 42. The first bracket 42 defines a longitudinal axis 74 and the second bracket 46 is movable between a first position (FIG. 1) and a second position (FIGS. 5 and 8). In the first position (FIG. 1) (i.e., an installed position), the second bracket 46 extends in a direction transverse to the longitudinal axis 74. In the illustrated embodiment, the second bracket 46 extends generally perpendicularly from the longitudinal axis 74. In the second position (FIGS. 5 and 8) (i.e., a shipping position) the second bracket 46 extends along the longitudinal axis 74. In other words, the second bracket 46 is movable between a generally horizontal position (FIG. 1) and a generally vertical position (FIGS. 5 and 8). In some embodiments, the second bracket 46 is movable to a third position that is between the first position and the second position. In other embodiments, the second bracket 46 is movable to any number of positions relative to the first bracket 42.

The positioning of the brackets 42, 46 can also be described relative to the frame assembly 14. The frame assembly 14 defines a display plane 78 in which to receive the sign face assembly 18. The first bracket 42 extends parallel to the display plane 78. In the illustrated embodiment, at least a portion of the first bracket 42 is positioned within the display plane 78 and the axis 50 is positioned within the display plane 78. The second bracket 46 is movable between a first position (FIG. 1) (i.e., the installed position) in which the second bracket 46 extends in a direction that intersects the display plane 78 and a second position (FIGS. 5 and 8) (i.e., the shipping position) in which the second bracket 46 extends in a direction parallel to the display plane 78.

With reference to FIG. 4B, a fastener 82 is received within in a first pair of holes 86 formed in the brackets 42, 46 when the second bracket 46 is in the first position, or the fastener 82 is received within a second pair of holes 90 formed in the brackets 42, 46 when the second bracket 46 is in the second position. In other words, the fastener 82 secures the position of the second bracket 46 relative to the first bracket 42.

Figure 4C:
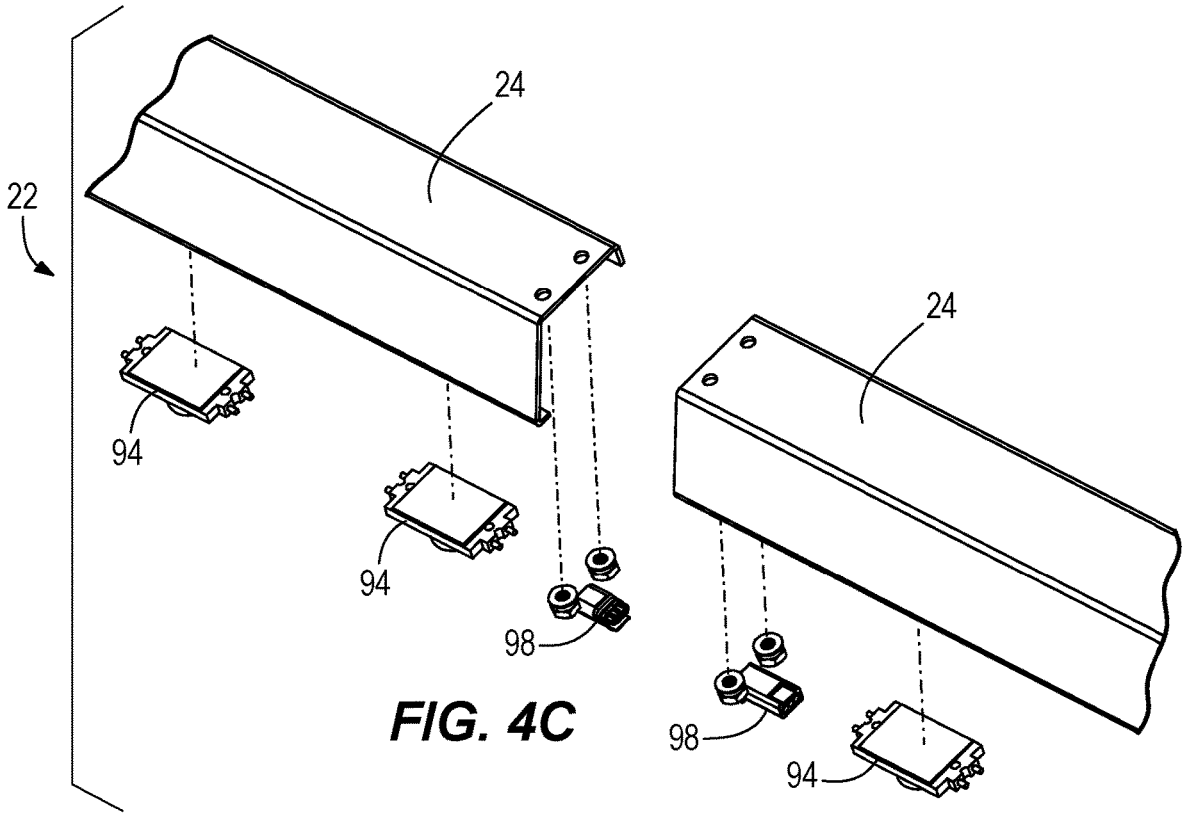
FIG. 4C is an enlarged, exploded view showing the quick connect electrical connectors used to connect electrical wiring modules of the light bar assembly of FIG. 4A.

With reference to FIGS. 4A and 4C, each light bar 24 of the light bar assembly 22 includes a plurality of light emitting element 94. In the illustrated embodiment, the light emitting element 94 is a light emitting diode (LED). The light bars 24 are electrically connected to each other. In particular, the light emitting elements 94 are electrically connected in parallel via electrical conductors or wires. Modules or strings of light emitting elements 94 are electrically connected together using quick-connect electrical connectors 98.

Figure 6:
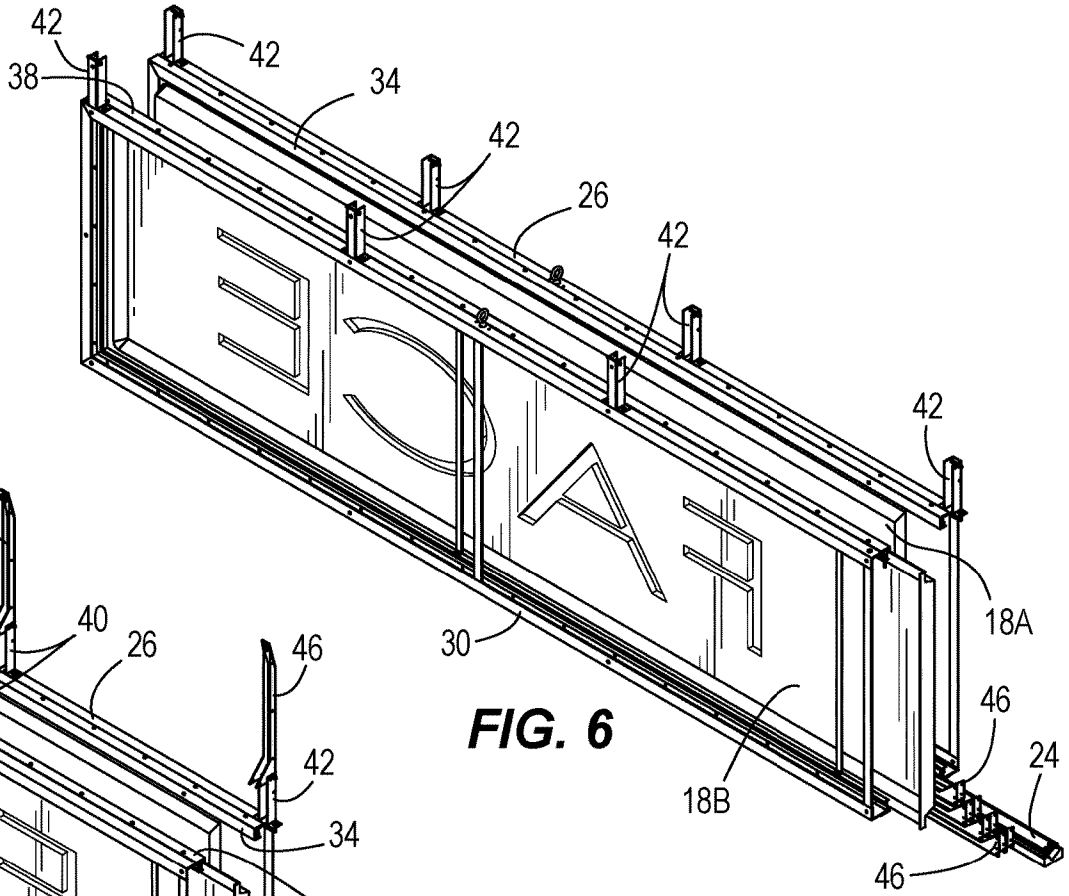
FIG. 6 is a perspective view of a compact shipping configuration of the front-illuminated sign according to another embodiment of the invention.

With reference to FIGS. 5 and 6, the sign 10 can be collapsed for compact shipping while maintaining easy assembly and installation of the sign 10 once the sign 10 has reached its installation destination. Specifically, the section frame section 30 is movable with respect to the first frame section 26 between an installed position (FIG. 1) and a collapsed position (FIGS. 5 and 6). When in the collapsed position, a front side 102 of the first frame section 26 faces a front side 106 of the second frame section 30. In other words, the frame sections 26, 30 and the frame members 34, 38 are positioned adjacent to each other for compactness during shipping. With reference to FIG. 5, the second bracket 46 is in the second position when the second frame section 30 is in the collapsed position. With reference to FIG. 6, the second bracket 46 is removed from the first bracket 42 when the second frame section 30 is in the collapsed position.

With continued reference to FIGS. 5 and 8, the first brackets 42 and the second brackets 46 are pre-installed on the frame assembly 14 during manufacturing before shipping the sign 10 and during shipment of the sign 10. In addition, two of the three light bars 24 are pre-installed to the second brackets 46 during manufacturing before shipping the sign 10 and during shipment of the sign 10. The center light bar 24 is not pre-installed but can be positioned between the frame sections 26, 30 (FIG. 5) during shipment of the sign 10. During shipping, the fastener 82 passes through the holes 90 to secure the second bracket 46 in the second position (FIG. 5). In other words, the sign 10 is shipped as shown in FIG. 5, with the frame sections 26, 30 collapsed and the brackets 42, 46 and at least some of the light bars 24 pre-installed. As such, the sign 10 is able to be shipped in a compact fashion, but still does not require a lot of assembly once the sign 10 arrives at the installation location.

Figure 9:
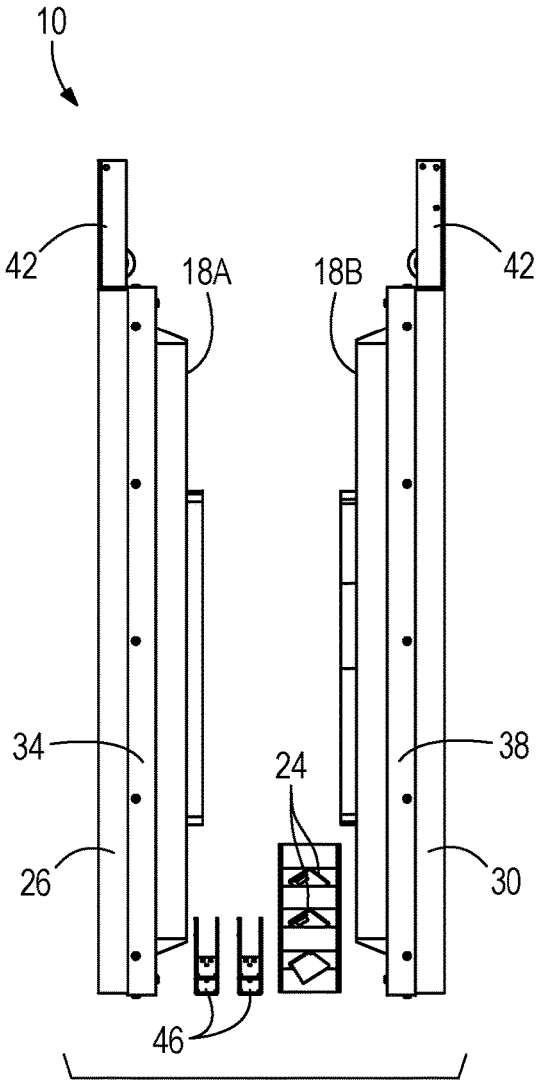
FIG. 9 is a side view of the compact shipping configuration of FIG. 6.

With reference to FIGS. 6 and 9, the sign 10 includes pre-installed first brackets 42 that are positioned in a direction parallel to frame sections 26, 30, similar to FIG. 5. However, the second brackets 46 and light bars 24 are not pre-installed in FIG. 6. Instead, the second brackets 46 and the light bars 24 are positioned between the frame sections 26, 30 for additional compactness during shipping.

Figure 7A:
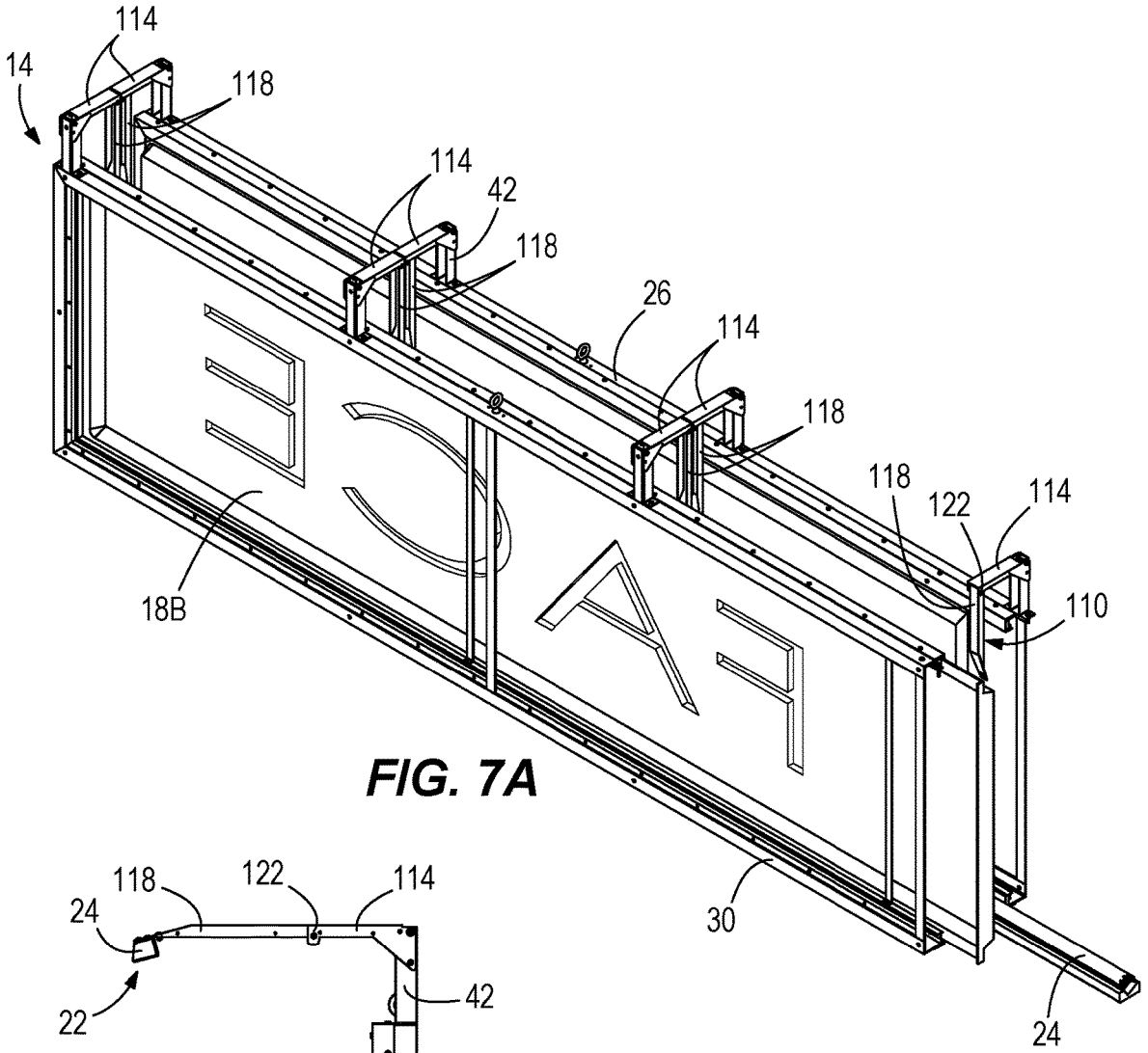
FIG. 7A is a perspective view of another compact shipping configuration of the front-illuminated sign according to another embodiment of the invention.
Figure 7B:
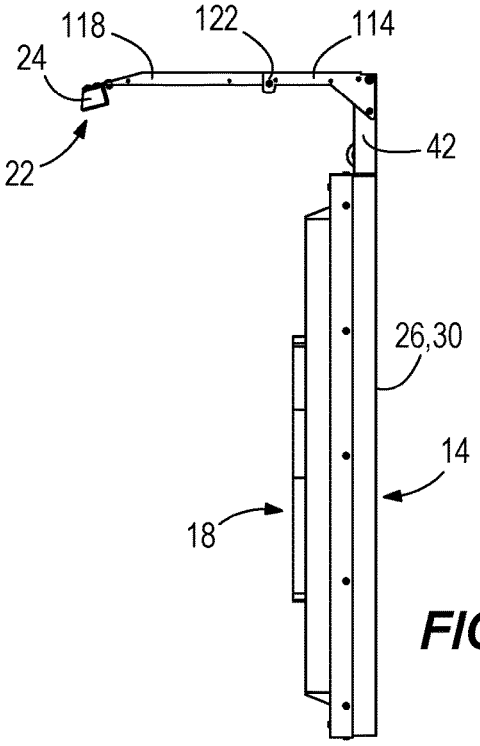
FIG. 7B is a side view that depicts the front-illuminated sign of FIG. 7A in the operating position.

With reference to FIGS. 7A and 7B, the sign 10 includes first brackets 42 and a second bracket 110 according to another embodiment of the invention. The second bracket 110 includes a first portion 114 and a section portion 118 rotatably coupled to the first portion 114. The first portion 114 is connected to the first bracket 42 and the second portion 118 is connected to the light bar 24. The second bracket 110 is movable between an installed position (FIG. 7B) and a shipping position (FIG. 7A) in which the section portion 118 is positioned adjacent the frame sections 26, 30. Specifically, the section portion 118 is rotatable with respect to the first portion 114 about an axis 122. In other words, the section portion 118 of the section bracket 110 is movable to be positioned between the frame sections 26, 30 during shipment of the sign in order to provide additional compactness while maintaining ease of assembly.

When the sign 10 is shipped and arrives at the installation location, the sign is moved from the compact shipping configuration (FIG. 5, 6, or 7A) to the installed configuration (FIG. 1) with a minimum number of installation steps. During installation of the front-illuminated sign 10, the light bars 24 are electrically connected using electrical connectors 98, and the frame sections 26, 30 and the frame members 34, 38 are interconnected. With reference to the shipping configuration of FIG. 6, the second brackets 46 are interconnected with first brackets 42. With reference to the shipping configurations of FIGS. 5 and 7A, the second brackets 46, 118 are rotated to their operational positions after removal of any retainers. The light bar assembly 22 is then interconnected and electrically coupled to a power supply. The light bars 24 are pre-aligned with the sign face assembly 18 during manufacturing.

Although the invention has been described in detail with reference to certain embodiments above, variations and modifications exist within the scope and spirit of one or more independent aspects of the invention as described.

The invention claimed is:

1. A sign comprising:

a frame configured to support a sign face in a display plane, the frame includes a first section and a second section, the second section is movable with respect to the first section between an installed position and a collapsed position, and wherein the second section and the first section are in the display plane when in the installed position;

a first bracket coupled to the frame, the first bracket defines a longitudinal axis;

a second bracket coupled to the first bracket, the second bracket rotatable with respect to the first bracket, and the second bracket is movable between a first position in which the second bracket extends transverse to the longitudinal axis and a second position in which the second bracket extends along the longitudinal axis; and a light bar coupled to the second bracket.

2. The sign of claim 1, wherein the frame defines a display plane and the first bracket extends parallel to the display plane.

3. The sign of claim 1, wherein a front side of the first section faces a front side of the second section when the second section is in the collapsed position.

4. The sign of claim 1, wherein the light bar includes a plurality of light emitting diodes.

5. The sign of claim 1, wherein the first bracket is coupled to the first section and the sign further includes a third bracket coupled to the second section; and a fourth bracket coupled to the third bracket, the fourth bracket rotatable with respect to the third bracket, and wherein the light bar is coupled to the fourth bracket when the second section is in the installed position.

6. A sign comprising:

a frame configured to support a sign face;

a first bracket coupled to the frame;

a second bracket coupled to the first bracket, the second bracket rotatable with respect to the first bracket about an axis;

a first light bar coupled to the second bracket; and a second light bar electronically coupled to the first light bar by a quick-connect electrical connector.

7. The sign of claim 6, wherein the first bracket defines a longitudinal axis, and wherein the second bracket is movable between a first position in which the second bracket extends transverse to the longitudinal axis; and a second position in which the second bracket extends along the longitudinal axis.

8. The sign of claim 7, wherein the second bracket is movable to a third position between the first position and the second position.

9. The sign of claim 6, wherein the frame defines a display plane and the first bracket extends parallel to the display plane.

10. The sign of claim 9, wherein at least a portion of the first bracket and the axis is positioned within the display plane.

11. The sign of claim 9, wherein the second bracket is movable between a first position in which the second bracket extends in a direction that intersects the display plane, and a second position in which the second bracket extends in a direction parallel to the display plane.

12. The sign of claim 6, wherein the first light bar includes a plurality of light emitting diodes.

13. The sign of claim 6, wherein the frame includes a first section and a second section that is movable with respect to the first section between an installed position and a collapsed position.

14. The sign of claim 13, wherein a front side of the first section faces a front side of the second section when the second section is in the collapsed position.

15. The sign of claim 13, wherein the first bracket is coupled to the second section of the frame.

16. The sign of claim 13, wherein the first bracket defines a longitudinal axis, and wherein the second bracket is movable between a first position in which the second bracket extends transverse to the longitudinal axis; and a second position in which the second bracket extends along the longitudinal axis; and wherein the second bracket is in the second position when the second section of the frame is in the collapsed position.

17. The sign of claim 13, wherein the frame further includes a third section that is positioned between the first section and the second section when the second section is in the installed position.

18. The sign of claim 6, wherein the second bracket includes a first portion and a section portion rotatably coupled to the first portion.

19. The sign of claim 18, wherein the first portion is connected to the first bracket and the second portion is connected to the light bar.

20. The sign of claim 19, wherein the second portion is movable to a position adjacent the frame.

* * * * *